US007882850B2

(12) United States Patent
Ball

(10) Patent No.: US 7,882,850 B2
(45) Date of Patent: Feb. 8, 2011

(54) DOOR FOR FABRIC ENCLOSURE

(76) Inventor: Allan Ball, 71 Allendale Drive, Winnipeg, Manitoba (CA) R3G 5B6

( * ) Notice: Subject to any disclaimer, the term of this patent is extended or adjusted under 35 U.S.C. 154(b) by 0 days.

(21) Appl. No.: 11/225,881

(22) Filed: Sep. 14, 2005

(65) Prior Publication Data

US 2006/0060235 A1 Mar. 23, 2006

Related U.S. Application Data

(60) Provisional application No. 60/610,178, filed on Sep. 16, 2004.

(51) Int. Cl.
*E04H 15/58* (2006.01)

(52) U.S. Cl. ..... 135/117

(58) Field of Classification Search ..... 135/117, 135/136, 115, 116, 87; 49/34; 160/354
See application file for complete search history.

(56) References Cited

U.S. PATENT DOCUMENTS

| | | | | | |
|---|---|---|---|---|---|
| 2,511,452 | A * | 6/1950 | Anderson et al. | 135/157 |
| 3,204,649 | A * | 9/1965 | Johnson | 52/2.14 |
| 3,387,412 | A * | 6/1968 | Kwake | 52/2.14 |
| 3,744,501 | A * | 7/1973 | Kozarsky | 52/2.12 |
| 4,000,749 | A * | 1/1977 | Busco | 600/21 |
| 4,220,298 | A * | 9/1980 | Willis | 244/129.5 |
| 4,556,391 | A * | 12/1985 | Tardivel et al. | 446/7 |
| 4,858,635 | A | 8/1989 | Eppenbach | |
| 4,945,584 | A * | 8/1990 | LaMantia | 5/97 |
| 5,487,400 | A * | 1/1996 | Dawkins | 135/87 |
| 5,592,961 | A * | 1/1997 | Chin | 135/125 |
| 6,016,823 | A * | 1/2000 | Hill | 135/124 |
| 6,071,174 | A * | 6/2000 | Yoon | 446/478 |
| 6,088,953 | A * | 7/2000 | Morgan | 47/31 |
| 6,109,281 | A * | 8/2000 | Lowenthal | 135/125 |
| 6,360,761 | B1 * | 3/2002 | Zheng | 135/126 |
| 6,371,144 | B1 * | 4/2002 | Ragatz | 135/156 |
| 2002/0157697 | A1 * | 10/2002 | Choi | 135/119 |
| 2003/0024560 | A1 * | 2/2003 | Tomason | 135/90 |
| 2004/0168714 | A1 * | 9/2004 | Zheng | 135/87 |
| 2008/0210283 | A1 * | 9/2008 | Hinz et al. | 135/121 |

* cited by examiner

*Primary Examiner*—David Dunn
*Assistant Examiner*—Noah Chandler Hawk
(74) *Attorney, Agent, or Firm*—Adrian D. Battison; Ade & Company Inc.

(57) ABSTRACT

In a fabric enclosure such as a tent wall there is provided an opening in the fabric panel with a fabric closure panel for closing the opening having a hinge line along one side connecting the closure panel to the wall panel. The opening and the closure panel each define an edge thereof opposite to the hinge line which is curved from an end at the hinge line around to an opposite end at the hinge line with the edge of the closure panel overlapping the edge of the opening for closure thereon and a flexible bowing strip attached to the edge of the closure panel which is forced into a bowed shape to apply tension to the closure panel tending to maintain the panel flat.

21 Claims, 6 Drawing Sheets

DOOR FOR FABRIC ENCLOSURE

This application claims the benefit under 35USC119 of the filing date of provisional application 60/610,178 filed Sep. 16, 2004.

The invention provides a new door and frame assembly to replace the common zipper door on camping tents, outdoor dining tents and screen rooms.

BACKGROUND OF THE INVENTION

The common camping, dining or screen tent typically utilizes a zippered flap of material or screen to act as the doorway into and out of the tent. To enter or exit the tent it is necessary to bend down, open the zipper, bend over and pass through the doorway, and then turn around and close the zipper. Because of the loose material, it often requires two hands, and is often difficult if a person is carrying something.

SUMMARY OF THE INVENTION

It is one object of the invention to provide an improved fabric enclosure with an improved door construction in one wall.

According to one aspect of the invention there is provided a fabric enclosure comprising:

a fabric wall panel of the enclosure;

an opening in the fabric panel; a fabric closure panel for closing the opening having a hinge line along one side connecting the closure panel to the wall panel;

the opening and the closure panel each defining an edge thereof opposite to the hinge line which is curved from an end at the hinge line around to an opposite end at the hinge line with the edge of the closure panel overlapping the edge of the opening for closure thereon;

and a flexible bowing strip attached to the edge of the closure panel which is forced into a bowed shape to apply tension to the closure panel tending to maintain the panel flat.

Preferably there is also a bowing strip around the edge of the opening for stiffening the wall panel.

Preferably the bowing strip is attached by a sleeve on the edge. The sleeve may be continuous or formed in pieces. Other fastening methods may be used.

Preferably each end of the bowing strip is contained in a retainer pocket so that it is located directly at the hinge line.

Preferably wherein there is a flexible stiffening band on each of the closure panel and the wall panel for engagement in the closed position with each of the bands having a wide surface flat on the fabric. This is preferably a band of a stiffer material which carries the closure system.

Preferably the flexible stiffening bands are located inwardly of the bowing strip.

Preferably the stiffening band carries a fastening system for releasably fastening the stiffening bands together.

Preferably the fastening system comprises hook and loop strips.

Preferably the edges are semi-circular.

Preferably the hinge line is inclined from the vertical so that the closure panel tends to hang into the closed position.

Considered broadly, tents disclosed herein are of a portable type, comprised of fabric roofs and walls and often including waterproof fabric floors. The tents are usually supported by rigid metal, fiberglass, or composite poles and frame. The entry method into and out of the tent is by means of a fabric zippered door. This invention utilizes a fabric door panel with a rigid arched frame comprising a segmented metal, fiberglass, or composite rod. The door frame, as part of the tent wall, also utilizes segmented metal, fiberglass, or composite rod to provide opening shape. The rods are assembled into one piece and when attached to the tent fabric form a bent rigid semi-circular arch. The rod is attached to the tent fabric by hoops of fabric around the periphery of the door and door opening. Overlapping fabric edges between the door and the frame in the tent wall prevent fly and mosquito egress. The door pivots on a reinforced fabric hinge. The door is opened in a conventional fashion, by pulling on a handle on one side, stepping through the doorway and closing the door behind. Velcro or magnetic closures keep the door closed. On most sloped wall tents, the door is also self-closing.

One variation of this invention would be the use of compressed gas tubes to provide the arched shape to the fabric door panel and door frame.

There is referenced a number of times herein the use of segmented rods for use as the bowing strip. Another variation would be the use of a continuous rod that rolled up for travel (somewhat like a tape measure). Another variation of this invention would be the use of non-segmented metal, fiberglass or composite flat bar to provide the arched shape to the fabric door panel and door frame.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION OF THE INVENTION

The embodiment comprises seventeen key components attached to the fabric tent wall 1, which include:

1—fabric tent wall,

2—fabric door,

3—stiffening fabric at hinge line;

4—flexible bowing strip-opening frame;

5—tension hoop—opening frame;

6—stiffened edge—opening frame;

7—bowing strip retainer—opening frame (one at the top of the door and one at the bottom);

8—bowing strip hook and loop restraint—opening frame (one at the top of the door and one at the bottom);

9—flexible bowing strip—door frame;

10—tension hoop—door frame

11—stiffened edge—door frame;

12—bowing strip retainer—door frame top;

13—bowing strip retainer—door frame bottom;
14—hook and loop/magnetic closure;
15—ground spike loop—side wall;
16—handle;
17—ground spike loop—corner;
18—conventional tent;
19—fabric hinge centerline;
20—reinforcement pad.

Figure 1:
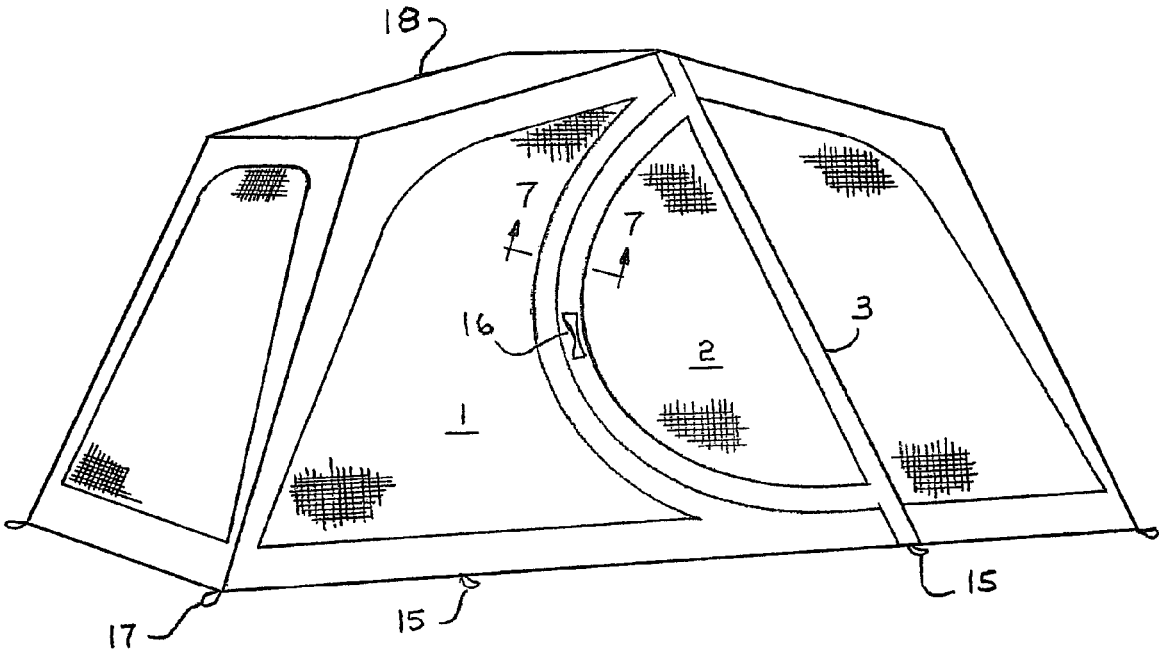
FIG. 1 is an isometric view of a conventional pole supported tent showing the tent door and frame on one side of the tent.
Figure 2:
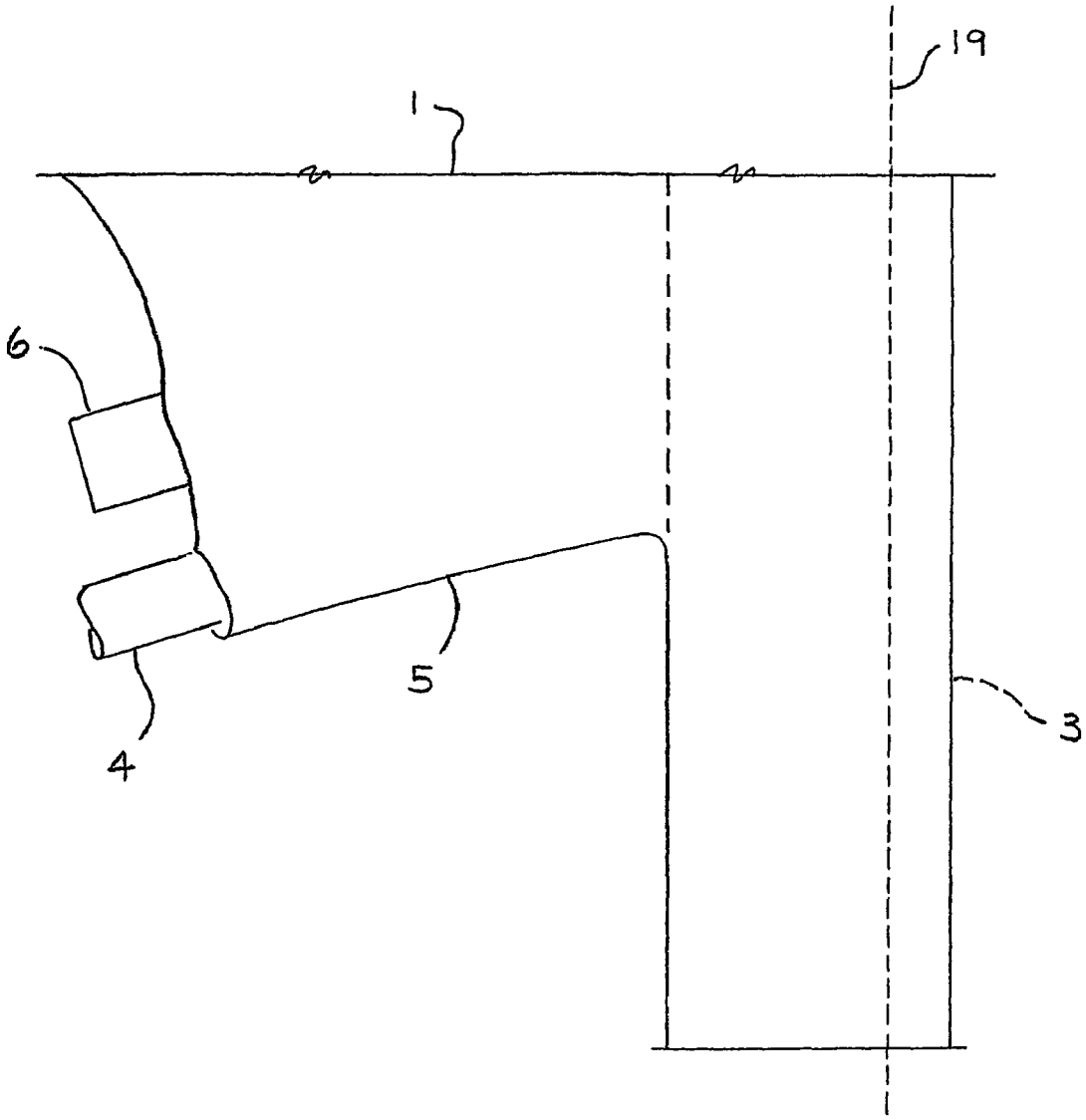
FIG. 2 is an elevational view of the opening tension hoop with the door tension hoop not shown for clarity.
Figure 3:
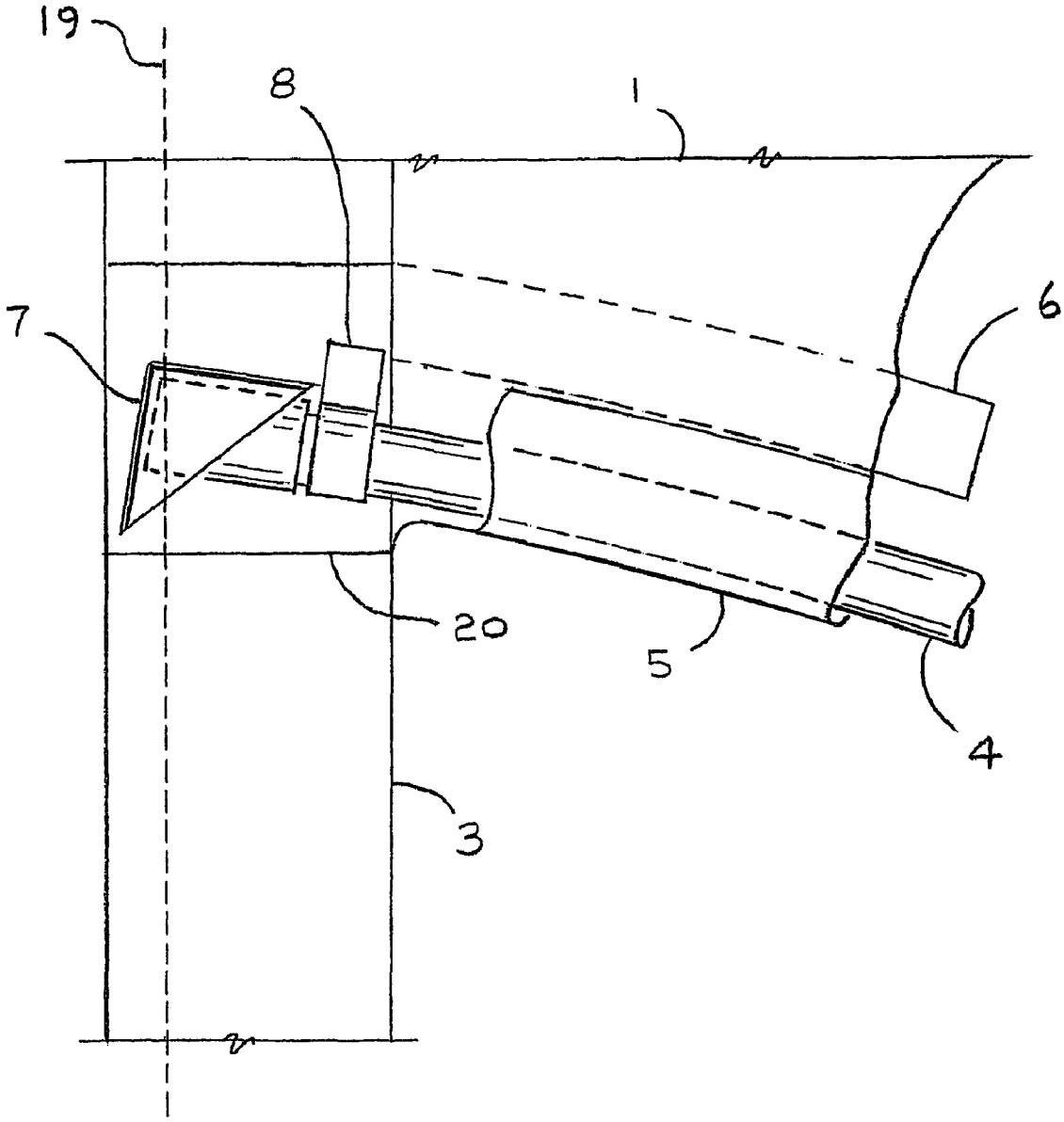
FIG. 3 is an elevational view of the opening tension hoop and top bowing strip retainer, viewed from inside the tent looking out.
Figure 4:
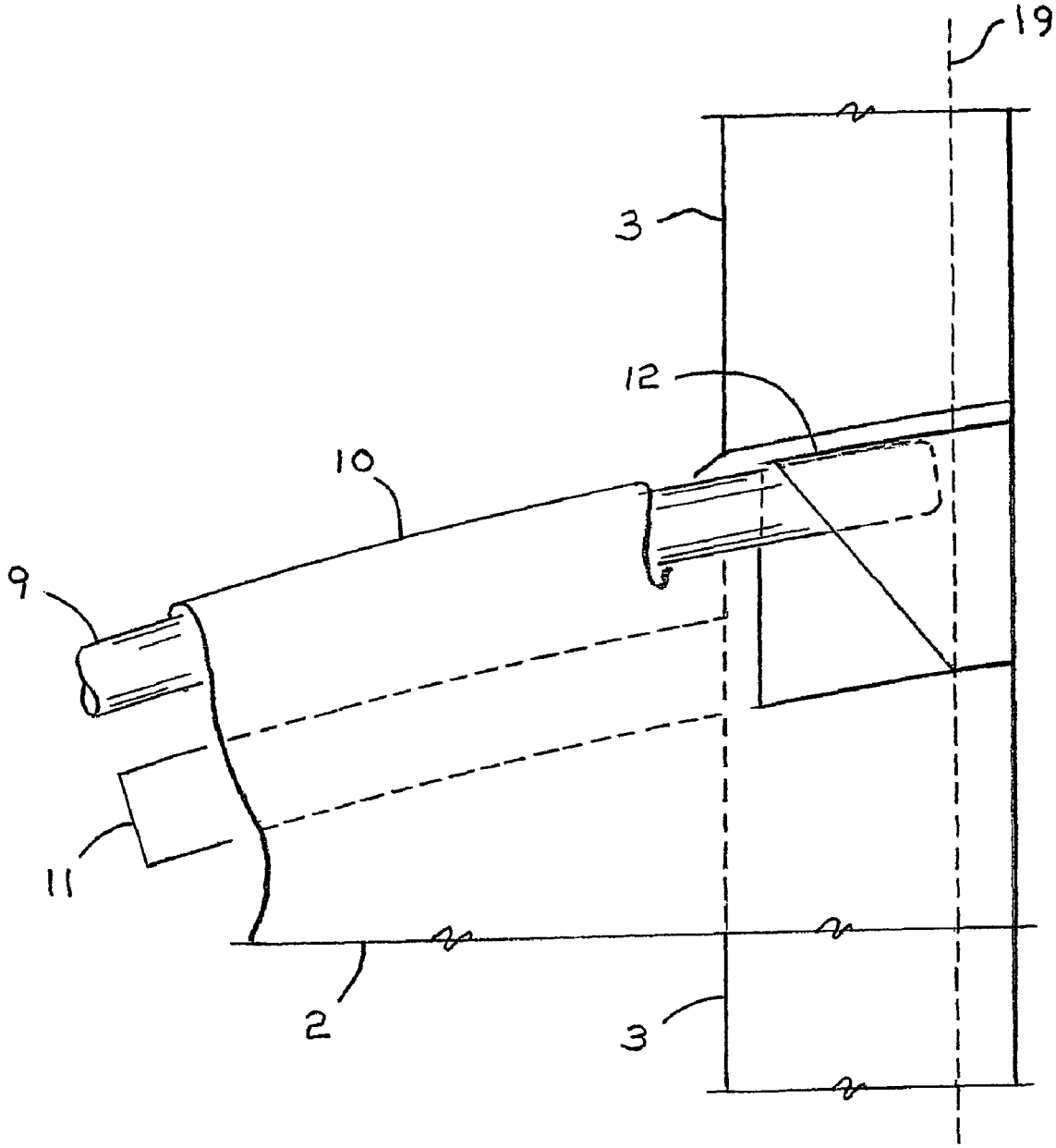
FIG. 4 is an elevational view of the door tension hoop and top bowing strip retainer.
Figure 5:
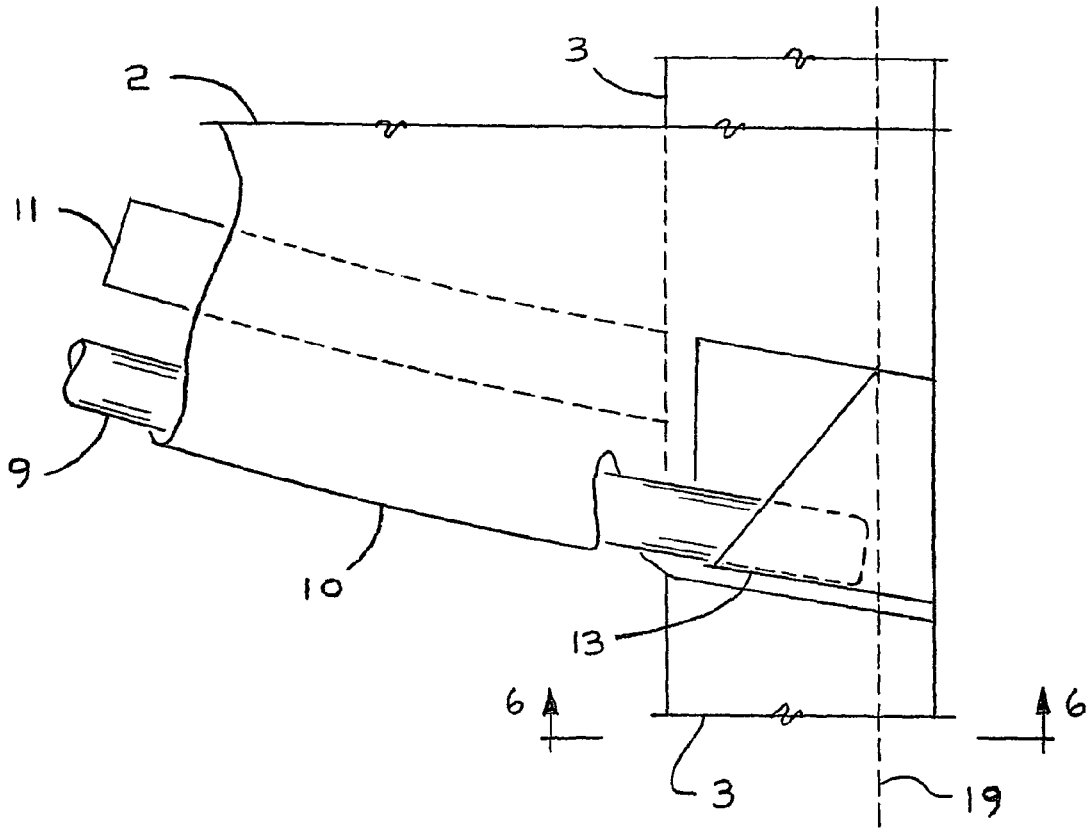
FIG. 5 is an elevational view of the door tension hoop and bottom bowing strip retainer.
Figure 6:
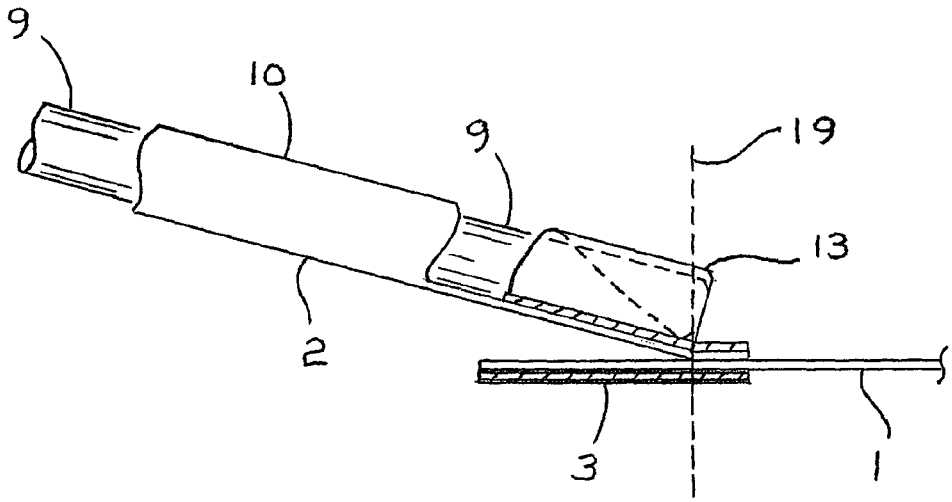
FIG. 6 is a section view of the door tension hoop and bottom bowing strip retainer along the lines 6-6 of FIG. 5.
Figure 7:
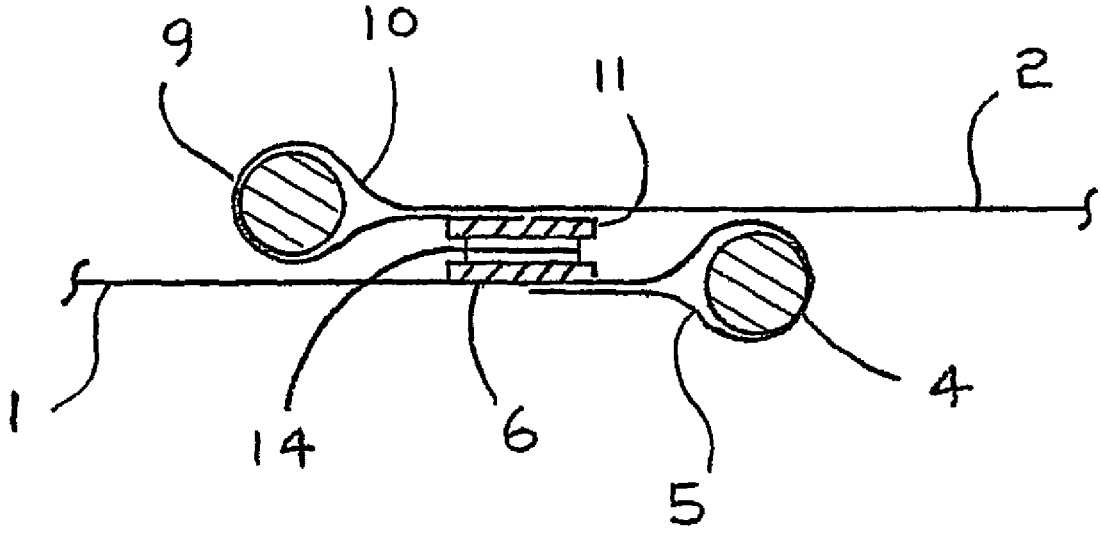
FIG. 7 is a section through the opening tension hoop and door tension hoop along the lines 7-7 of FIG. 1 and showing the general relationship between the two when the door is closed.

The invention provides a door assembly and an opening assembly. A general arrangement of the two assemblies is shown in FIG. 2.

The door assembly provides a straight segmented flexible bowing strip door frame 9 (constructed of metal, fiberglass or composites), which is inserted into a semi-circle-shaped door frame tension hoop 10 (constructed of fabric) attached to the fabric door 2. The ends of the flexible bowing strip door frame 9 are positioned and restrained by the bowing strip retainers 12 and 13 (constructed of reinforced plastic or fabric) at the top and bottom of the door. Insertion of the bowing strip 9 into the semi-circle shaped tension hoop 10 and bowing strip restraint by the bowing strip retainers 12 and 13 causes the door fabric to be stretched tight and maintain the shape bowing strip 9 into the semi-circle-shaped door frame tension hoop 10. A fabric handle 16 provides a convenient grasp for opening the door. As shown in F*igure* 6, the bowing strip retainers or pockets 12 and 13 are pivotal relative to the fabric of the tent wall 3 to allow the bowing strip to hinge relative to the tent wall.

The opening assembly consists of a straight segmented flexible bowing strip opening frame 4 (constructed of metal, fiberglass or composites), which is inserted into a semi-circle-shaped opening frame tension hoop 5 (constructed of fabric) attached to the tent wall. The ends of the flexible bowing strip opening frame 4 are positioned and restrained by the bowing strip retainers 7 (constructed of reinforced plastic or fabric) and bowing strip hook and loop restraints 8 at the top and bottom of the door opening. Insertion of the straight bowing strip 4 into the semi-circle-shaped opening frame tension hoop 5 and bowing strip restraint by the bowing strip retainers 7 and bowing strip hook and loop restraints 8 causes the tent wall to be tight and the door opening to match the shape and size of the door. A reinforcement pad 20 provides additional strength to the fabric of the assembly.

The door assembly has a stiffened edge 11 which is a band of stiffer material fastened to the fabric extending around the semi-circle defined by the inside of the door frame tension hoop 10 which mates with a stiffened edge 6 on the outside of the opening frame tension hoop 5. The purpose of the stiffened edge is to restrict mosquito and fly egress into the tent. At intervals along the stiffened edge, hook and loop/magnetic closures 14 provide attachment of the door assembly to the opening assembly in order to resist the wind from opening the door assembly. A stiffening fabric at the hinge line 3 allows the door to rotate about the plane of the tent wall. Side wall ground spike loop 15 allows attachments of the stiffening fabric to the ground to maintain the position of the door frame tension hoop 10 relative to the opening frame hoop 5.

The embodiment herein has the following features:

1. In a camping, dining or screen tent, the use of a rigidly framed door assembly and rigidly framed opening assembly, the combination of which provides convenient hinged door access to and from the tent.
2. The rigidly framed door assembly comprising of a straight segmented flexible bowing strip door frame 9, held in tension in a semi-circle shape by bowing strip retainers 12 and 13.
3. The rigidly framed opening assembly comprising of a straight segmented flexible bowing strip opening frame 4, held in tension in a semi-circle shape by bowing strip retainers 7 and bowing strip hook and loop restraints 8.
4. The door frame tension hoop 10 and opening frame tension hoop 5 which give shape to the door and tent wall fabric.
5. The stiffened edges 6 and 11 to resist mosquitoes and flies from entering the tent.
6. The hook and loop/magnetic closures 14 to prevent the unintended opening of the door assembly.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A fabric structure comprising:

a fabric wall panel of the fabric structure defining a plane of the panel and defining side edges of the wall panel;

an opening in the fabric wall panel;

a fabric closure panel for closing the opening having a hinge line along one side connecting the closure panel to the wall panel;

wherein the fabric wall panel at the opening and the fabric closure panel each define an edge thereof opposite to the hinge line which is curved from an end at the hinge structure around to an opposite end at the hinge structure with the edge of the fabric closure panel overlapping the edge of the fabric wall panel at the opening for closure thereon;

wherein the fabric closure panel when closing the opening lies substantially in a common plane with the plane of the fabric wall panel;

the hinge line being spaced from an adjacent side edge of the wall panel;

a flexible bowing strip attached to the edge of the fabric closure panel opposite to the hinge line, which bowing strip is forced into a bowed shape from an initial different shape such that the flexible bowing strip tends to return to the initial shape generating forces in the bowing strip biasing ends of the bowing strip apart;

and wherein the flexible bowing strip is attached to the edge of the closure panel such that the forces in the bowing strip biasing the ends of the bowing strip apart act to apply tension to the closure panel tending to maintain the panel flat.

2. The fabric structure according to claim 1 wherein there is also a second flexible bowing strip attached to the edge of the opening opposite to the hinge line, which second bowing strip is forced into a bowed shape from an initial different shape such that the flexible bowing strip tends to return to the initial shape.

3. The fabric structure according to claim 1 wherein the flexible bowing strip is attached to the edge of the closure panel by a sleeve on the edge of the closure panel.

4. The fabric structure according to claim 3 wherein the sleeve on the edge of the closure panel extends around the full edge of the closure panel.

5. The fabric structure according to claim 1 wherein each end of the bowing strip is contained in a respective retainer pocket attached to the fabric wall panel so as to transfer the tension from the bowing strip into the fabric wall panel; the respective retainer pocket on the fabric wall panel being mounted on the fabric wall panel for pivotal movement of the respective retainer pocket relative to the fabric wall panel about the hinge line, where the hinge line lies at an angle to the bowing strip at the end of the bowing strip.

6. The fabric structure according to claim 5 wherein there is a second flexible bowing strip attached to the edge of the opening opposite to the hinge structure, which second bowing strip is forced into a bowed shape from an initial different shape such that the flexible bowing strip tends to return to the initial shape.

7. The fabric structure according to claim 5 wherein the flexible bowing strip is attached to the edge of the closure panel by a sleeve on the edge of the closure panel.

8. The fabric structure according to claim 5 wherein the bowing strip is continuously curved.

9. The fabric structure according to claim 1 wherein there is a first flexible stiffening band on the closure panel extending around the edge of the fabric closure panel alongside the flexible bowing strip and there is a second flexible stiffening band extending around the edge of the fabric wall panel and engaging the first flexible stiffening band in the closed position.

10. The fabric structure according to claim 9 wherein the first flexible stiffening band is located on a side of the flexible bowing strip of the closure panel toward the hinge line, and the second stiffening band is located on a side of the flexible bowing strip of the opening away from the hinge line.

11. The fabric structure according to claim 9 wherein the first and second stiffening bands carry a fastening system for releasably fastening the first and second stiffening bands together.

12. The fabric structure according to claim 11 wherein the fastening system comprises hook and loop strips.

13. The fabric structure according to claim 1 wherein the edge of the opening and the edge of the closure panel are substantially semi-circular.

14. The fabric structure according to claim 1 wherein the hinge line lies in a plane of the fabric wall panel and is inclined in that plane in a direction such that, when viewed in a front elevation of the fabric closure panel, the hinge line is inclined to the vertical in a direction such that a top end of the hinge line is located to a side of a bottom end of the hinge line toward the closure panel.

15. The fabric structure according to claim 14 wherein there is a second flexible bowing strip attached to the edge of the opening opposite to the hinge structure, which second bowing strip is forced into a bowed shape from an initial different shape such that the flexible bowing strip tends to return to the initial shape.

16. The fabric structure according to claim 14 wherein the flexible bowing strip is attached to the edge of the closure panel by a sleeve on the edge of the closure panel.

17. The fabric structure according to claim 14 wherein the bowing strip is continuously curved.

18. The fabric structure according to claim 14 wherein each end of the bowing strip is contained in a retainer pocket attached to the fabric wall panel so as to transfer the tension from the bowing strip into the fabric wall panel and wherein the respective retainer pocket on the fabric wall panel is mounted on the fabric wall panel for pivotal movement of the respective retainer pocket relative to the fabric wall panel about the hinge structure, where the hinge structure lies at an angle to the bowing strip at the end of the bowing strip.

19. The fabric structure according to claim 1 wherein the bowing strip is continuously curved.

20. A fabric structure comprising:

a fabric wall panel of the fabric structure defining a plane of the fabric wall panel and defining side edges of the fabric wall panel;

an opening in the fabric wall panel;

a fabric closure panel for closing the opening having a hinge line along one side connecting the fabric closure panel to the fabric wall panel;

the fabric wall panel at the opening and the fabric closure panel each defining an edge thereof opposite to the hinge line which is curved from an end at the hinge line around to an opposite end at the hinge line with the edge of the fabric closure panel overlapping the edge of the fabric wall panel at the opening for closure thereon;

the fabric closure panel when closing the opening lying substantially in a common plane with the plane of the fabric wall panel;

the hinge line being spaced from an adjacent side edge of the wall panel;

and a flexible bowing strip attached to the edge of the fabric closure panel opposite to the hinge line, which bowing strip is forced into a bowed shape from an initial different shape such that the flexible bowing strip tends to return to the initial shape generating forces in the bowing strip biasing ends of the bowing strip apart;

wherein the flexible bowing strip is attached to the edge of the fabric closure panel by a sleeve on the edge of the fabric closure panel;

the flexible bowing strip being attached to the edge of the closure panel such that the forces in the bowing strip biasing the ends of the bowing strip apart act to apply tension to the closure panel tending to maintain the panel flat;

wherein each end of the bowing strip is contained in a respective flexible retainer pocket member attached to the fabric wall panel and defining a pocket into which an end of the flexible bowing strip is inserted;

the respective retainer pocket member attached to the fabric wall panel;

the retainer pocket member allowing pivotal movement of the pocket relative to the fabric wall panel about the hinge line;

wherein the hinge line extends transversely across the retainer pocket member and transversely relative to the bowing strip at the end of the bowing strip.

21. A fabric structure comprising:

a fabric wall panel of the fabric structure defining a plane of the fabric wall panel and defining side edges of the fabric wall panel;

an opening in the fabric wall panel;

a fabric closure panel for closing the opening having a hinge line along one side connecting the fabric closure panel to the fabric wall panel;

the fabric wall panel at the opening and the fabric closure panel each defining an edge thereof opposite to the hinge line which is continuously curved from an end at the hinge line around to an opposite end at the hinge line with the edge of the fabric closure panel overlapping the edge of the fabric wall panel at the opening for closure thereon;

the fabric closure panel when closing the opening lying substantially in a common plane with the plane of the fabric wall panel;

the hinge line being spaced from an adjacent side edge of the wall panel;

and a flexible bowing strip attached to the edge of the fabric closure panel opposite to the hinge line, which bowing strip is forced into a bowed shape from an initial different shape such that the flexible bowing strip tends to return to the initial shape generating forces in the bowing strip biasing ends of the bowing strip apart;

wherein the flexible bowing strip is attached to the edge of the fabric closure panel by a sleeve on the edge of the fabric closure panel;

the flexible bowing strip being attached to the edge of the closure panel such that the forces in the bowing strip biasing the ends of the bowing strip apart act to apply tension to the closure panel tending to maintain the panel flat;

wherein each end of the bowing strip is contained in a respective flexible retainer pocket member attached to the fabric wall panel and defining a pocket into which an end of the flexible bowing strip is inserted;

the respective retainer pocket member attached to the fabric wall panel;

the retainer pocket member allowing pivotal movement of the pocket relative to the fabric wall panel about the hinge line;

wherein the hinge line extends transversely across the retainer pocket member and transversely relative to the bowing strip at the end of the bowing strip;

wherein the flexible bowing strip is attached to the edge of the fabric closure panel by a sleeve on the edge of the fabric closure panel which extends around the full edge of the fabric closure panel;

wherein there is provided a fastening system including a first portion extending around and adjacent to the edge of the opening and a second portion extending around and adjacent to the edge of the fabric closure panel for releasably fastening the first and second portions together;

wherein the edge of the opening and the edge of the fabric closure panel are substantially semi-circular;

and wherein the hinge line lies in a plane of the fabric wall panel and is inclined in that plane in a direction out of the vertical so as to apply a closing force to the fabric closure panel.

* * * * *